US006428370B1

(12) United States Patent
Jones

(10) Patent No.: US 6,428,370 B1
(45) Date of Patent: Aug. 6, 2002

(54) WATER JET PROPULSION SYSTEM HAVING REVERSE GATE OPTIMIZED FOR BRAKING

(75) Inventor: James R. Jones, Neosho, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/928,638

(22) Filed: Aug. 13, 2001

(51) Int. Cl.[7] ..... B63H 11/11

(52) U.S. Cl. ..... 440/38; 440/41

(58) Field of Search ..... 440/38, 39, 40, 440/41, 42, 43

(56) References Cited

U.S. PATENT DOCUMENTS

| | | | | |
|---|---|---|---|---|
| 4,992,065 A | * | 2/1991 | Torneman et al. | 440/38 |
| 5,752,864 A | | 5/1998 | Jones et al. | 440/41 |
| 6,183,318 B1 | * | 2/2001 | Tsumiyama et al. | 440/38 |
| 6,244,913 B1 | * | 6/2001 | Matsumoto et al. | 114/55.5 |
| 6,267,633 B1 | | 7/2001 | Yamaha | |

OTHER PUBLICATIONS

Bombardier "Sea–Doo", Parts Catalog 1999, GTX Limited 5888/5889, p. C10 to D1, D11 and D12, Jan. 1999.

Bombardier "Sea–Doo", Parts Catalog 2000, RX DI 5646/5656, p. C7, C8, C10 and C11, Apr. 2000.

www.berkeleyjet.com; copyright 1999.

www.hamiltonjet.com.

* cited by examiner

*Primary Examiner*—Stephen Avila
(74) *Attorney, Agent, or Firm*—Ostrager Chong & Flaherty LLP

(57) ABSTRACT

A water jet apparatus for a boat has a reverse gate optimized for braking. The reverse gate has a pair of flow-reversing passages for providing reverse thrust when the reverse gate is deployed and a lateral steering passage for directing flow, discharged to one side by the steering nozzle, to the opposite side. The flow-reversing passages start on opposite sides of a deflector body and curve outward and forward. The lateral steering passage is located aft of the deflector body and reversing passages and has discharge openings on opposite ends thereof, i.e., on the port and starboard sides of the reverse gate. The center of the aft wall of the reversing passages has an aperture, which allows water discharged from the steering nozzle to enter the steering passages. The deflector is situated in front of the aperture to deflect the pump discharge to the sides. The deflector takes the form of a flat body having an oval cross section with rounded side edges and having an hourglass shape when viewed from the front. Preferably, the deflector body has a vertically curved front surface, the curvature being centered at the pivot axis of the reverse gate.

32 Claims, 9 Drawing Sheets

| FIG.2A | FIG.2B |
|---|---|

WATER JET PROPULSION SYSTEM HAVING REVERSE GATE OPTIMIZED FOR BRAKING

FIELD OF THE INVENTION

This invention generally relates to water jet apparatus for propelling boats and other watercraft. In particular, the invention relates to mechanisms for shifting a water jet apparatus to selectively propel a craft in the forward or reverse direction.

BACKGROUND OF THE INVENTION

It is known to provide a mechanism for reversing the direction of the water flow exiting the steering nozzle of a water jet propulsion system. The reverse gate is typically pivotable about a horizontal axis between up and down positions. In the up position, the reverse gate is clear of the water flow exiting the steering nozzle. In the down position, the reverse gate is disposed in the path of the exiting water flow. In its simplest embodiment, the reverse gate has a U-shaped channel which reverses the water flow exiting the steering nozzle.

It would be desirable if a boat operator could use the reverse gate as a brake when the boat is moving forward and needs to be stopped quickly. However, in order to accomplish this, what is needed is a reverse gate which can be deployed and retracted quickly.

SUMMARY OF THE INVENTION

The present invention is directed to a non-steerable reverse gate having a structure which is optimized for use in braking a forward-moving boat or other watercraft. In particular, this reverse gate is designed for quick deployment/retraction. The latter characteristic is critical to reverse function as a brake. The reverse gate is also designed so that the steering response in reverse is the same as an outboard or inboard/outboard. In effect, the transom thrusts to the side that the steering wheel is turned to.

In accordance with one preferred embodiment of the invention, the reverse gate comprises a pair of flow-reversing passages for providing reverse thrust when the reverse gate is deployed, a lateral steering passage for directing flow, discharged to one side by the steering nozzle, to the opposite side, and a central deflector body. The flow-reversing passages start on opposite sides of the deflector body and curve outward and forward. The lateral steering passage is located aft of the deflector body and reversing passages and has discharge openings on opposite ends thereof, i.e., on the port and starboard sides of the reverse gate. The center of the aft wall of the reversing passages has an aperture, which allows water discharged from the steering nozzle to enter the steering passages. The deflector is situated in front of the aperture to deflect the pump discharge to the sides. The deflector in accordance with the preferred embodiments takes the form of a flat body having an oval cross section with rounded side edges and having an hourglass shape when viewed from front or rear. The front surface of the flat body is preferably either laterally and vertically straight or laterally straight and vertically curved.

The front surface of the deflector body directly opposes the steering nozzle outlet when the latter is in its central position. A reverse gate having the above-described structure functions to some degree as a pressure vessel with four discharge ports. When the steering nozzle is centered, the primary water exit path is spray which bounces off of the deflector and flows forward through the reversing passages. Steering, i.e., turning the steering nozzle about its pivot axis, allows some of the nozzle discharge to miss the deflector and escape around the backside, through the aperture behind the deflector body and into the steering passages. The flow around the deflector is facilitated by the Coanda effect.

Preferably, the deflector has a vertical rib on the centerline to split the nozzle discharge. This has the effect of obstructing the flow from transitioning to steering thrust too suddenly.

In accordance with the first preferred embodiment, the discharge "splay" angle at the reversing passage outlet was approximately 10 degrees per side. This angle optimized reverse thrust as well as reducing the counteracting steering thrust. However, other angles can be used. Preferably the discharge angle of the reversing passages in the preferred embodiments is selected to reduce opposing steering thrust.

The first preferred embodiment further comprises a pair of baffles located in the reversing passages adjacent to the steering nozzle. These baffles enhance steering thrust by directing more water around the deflector when the steering nozzle is turned.

In accordance with a second preferred embodiment, the deflector body has a concave front surface which is curved vertically and straight laterally, forming a simple curve. Preferably, the simple curve is an arc centered at the gate pivot centerline, to reduce opening and closing loads. This deflector improves steering thrust significantly. Also, the surfaces of the reverse housing immediately adjacent to the steering aperture are curved vertically and straight laterally, forming a simple curve. This structural feature straightens the flow and defines the discharge angle. The steering thrust creates a venturi effect, which scavenges the opposite side of the steering passage and perhaps the forward section of the reverse gate. Other structural features of the second preferred embodiment are similar to those of the first preferred embodiment.

DETAILED DESCRIPTION OF THE PREFERRED EMBODIMENTS

Figures 1, 1A:
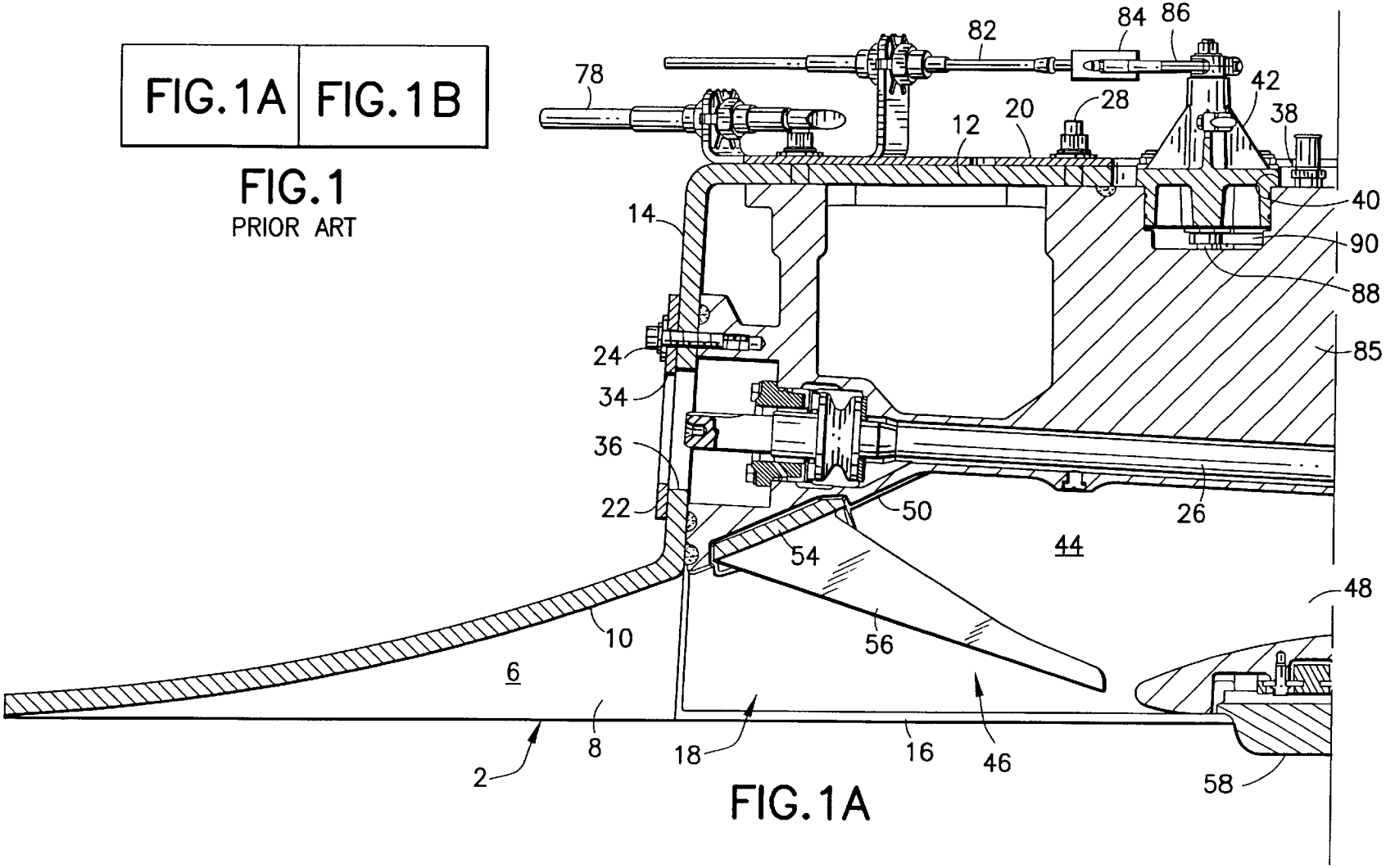
FIG. 1 PRIOR ART
FIG. 1 is a schematic (presented in two sheets respectively labeled FIGS. 1A and 1B) showing a sectional view of a known water jet propulsion system mounted to a boat hull, the section being taken along a vertical midplane.
Figure 1B:
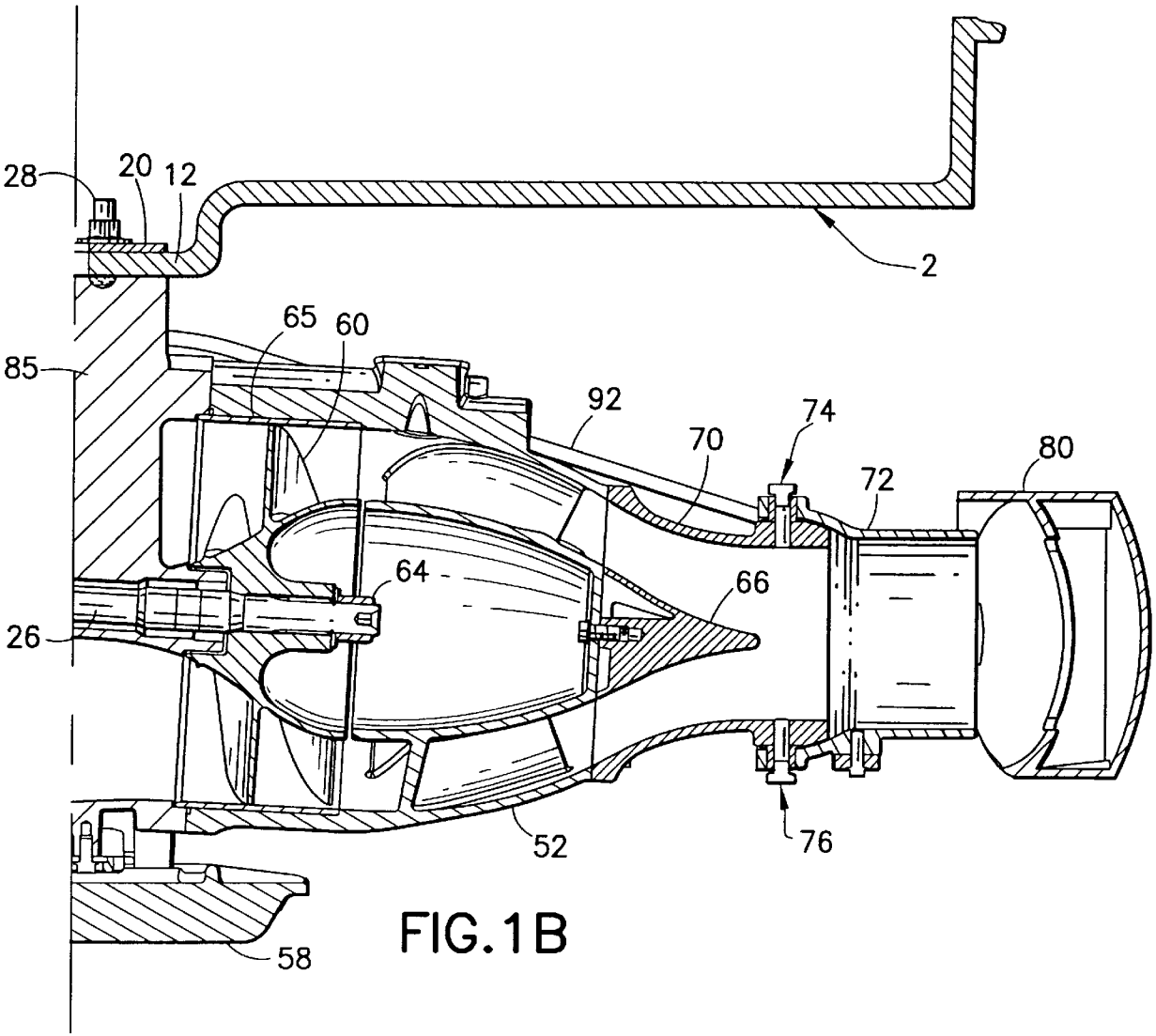
Figures 2, 2A:
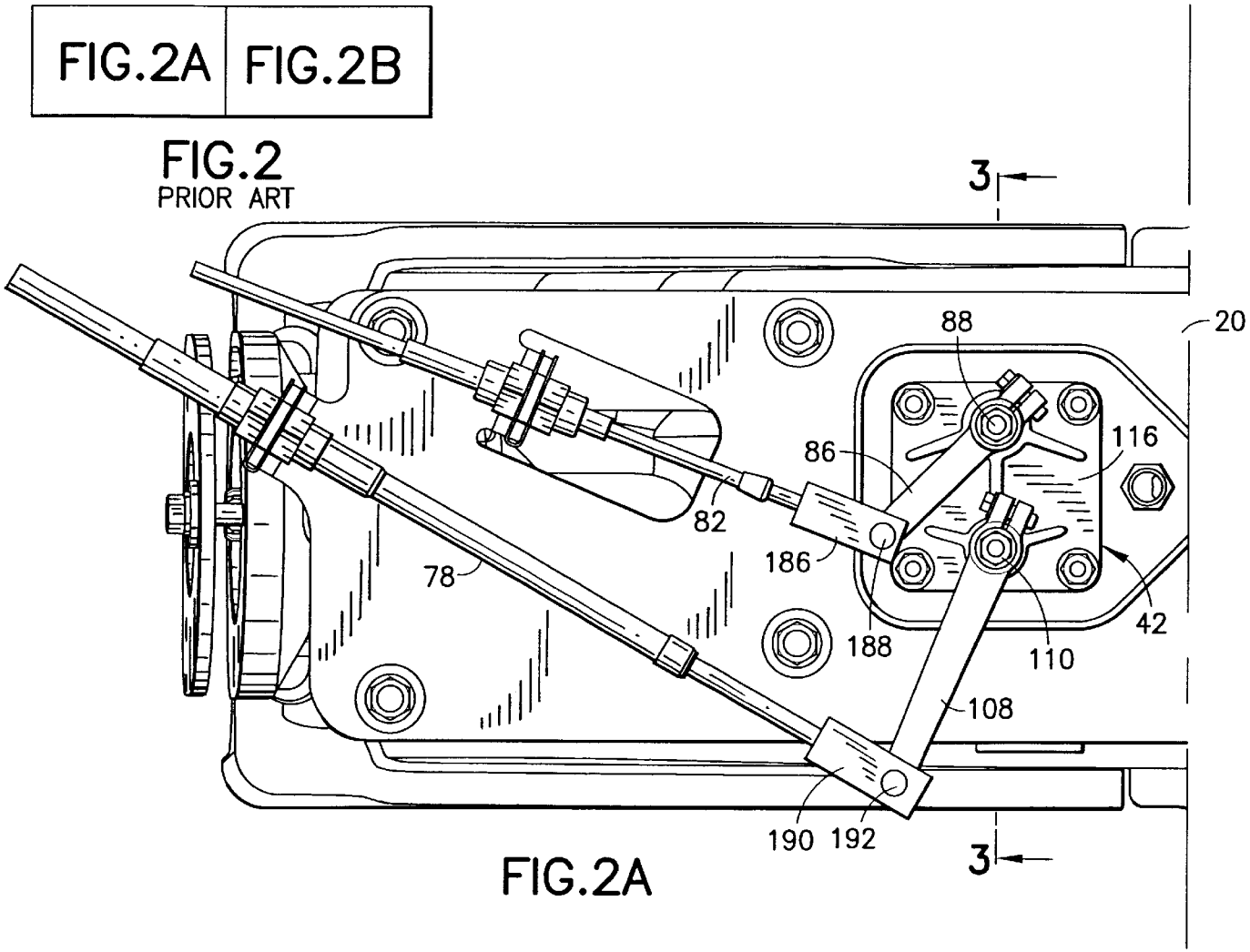
FIG.2 PRIOR ART
FIG. 2 is a schematic (presented in two sheets respectively labeled FIGS. 2A and 2B) showing a top view of the top mounting plate and the water jet apparatus depicted in FIG. 1, with the hull removed.
Figure 2B:
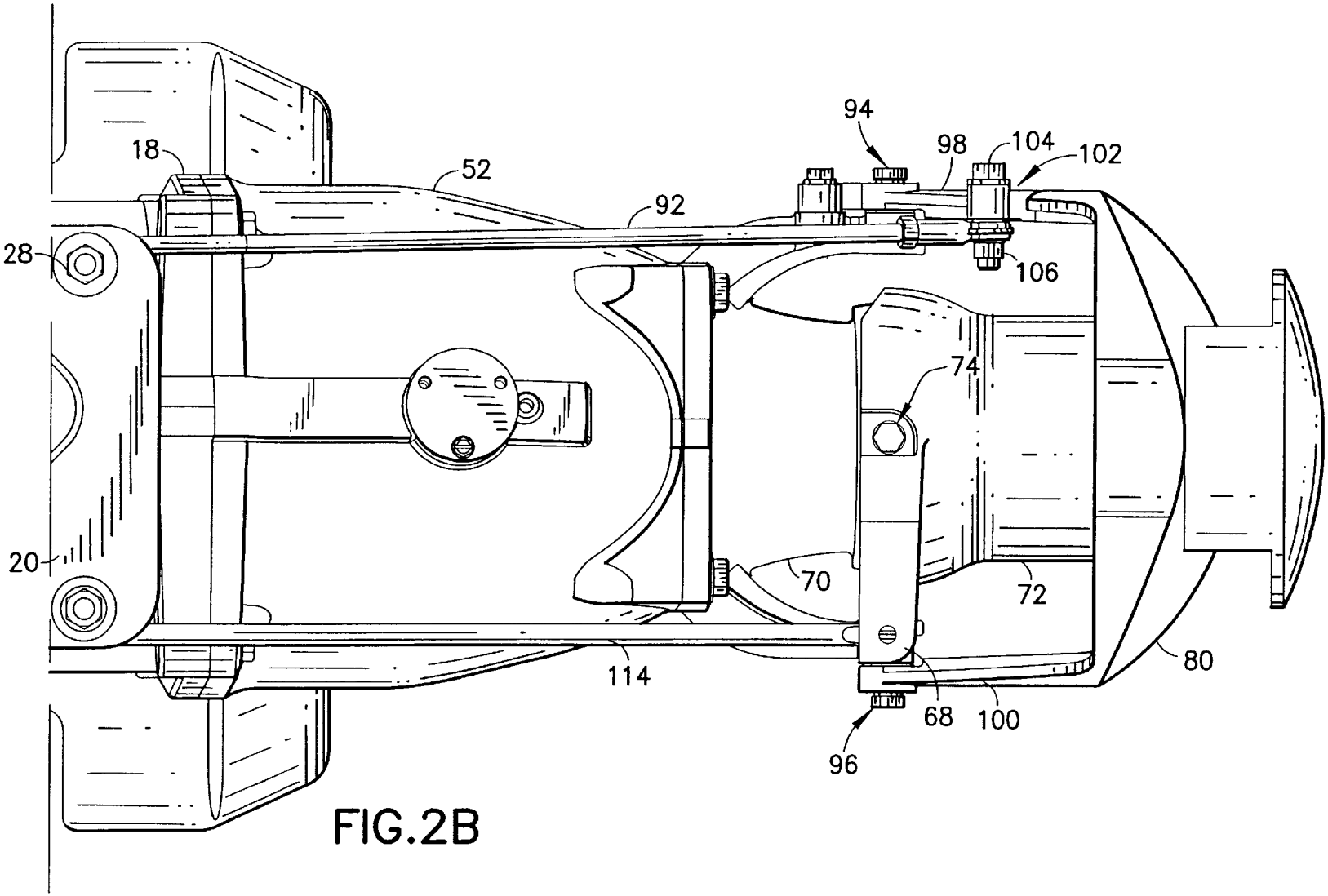
Figure 3:
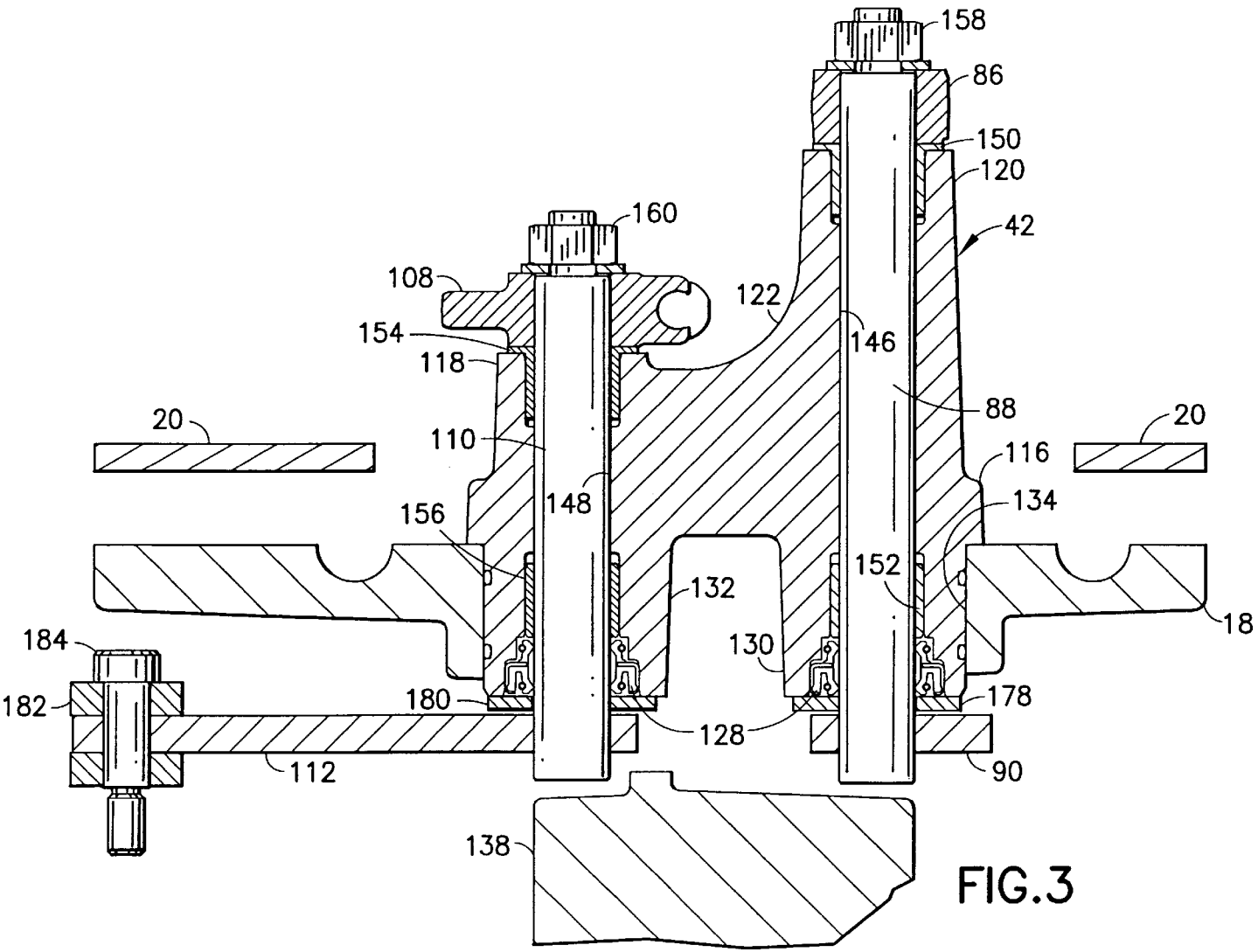
FIG. 3 is a schematic showing a sectional view of the shift and steering control housing shown in FIG. 2A, the section being taken along line 3—3 in FIG. 2A.
Figure 4:
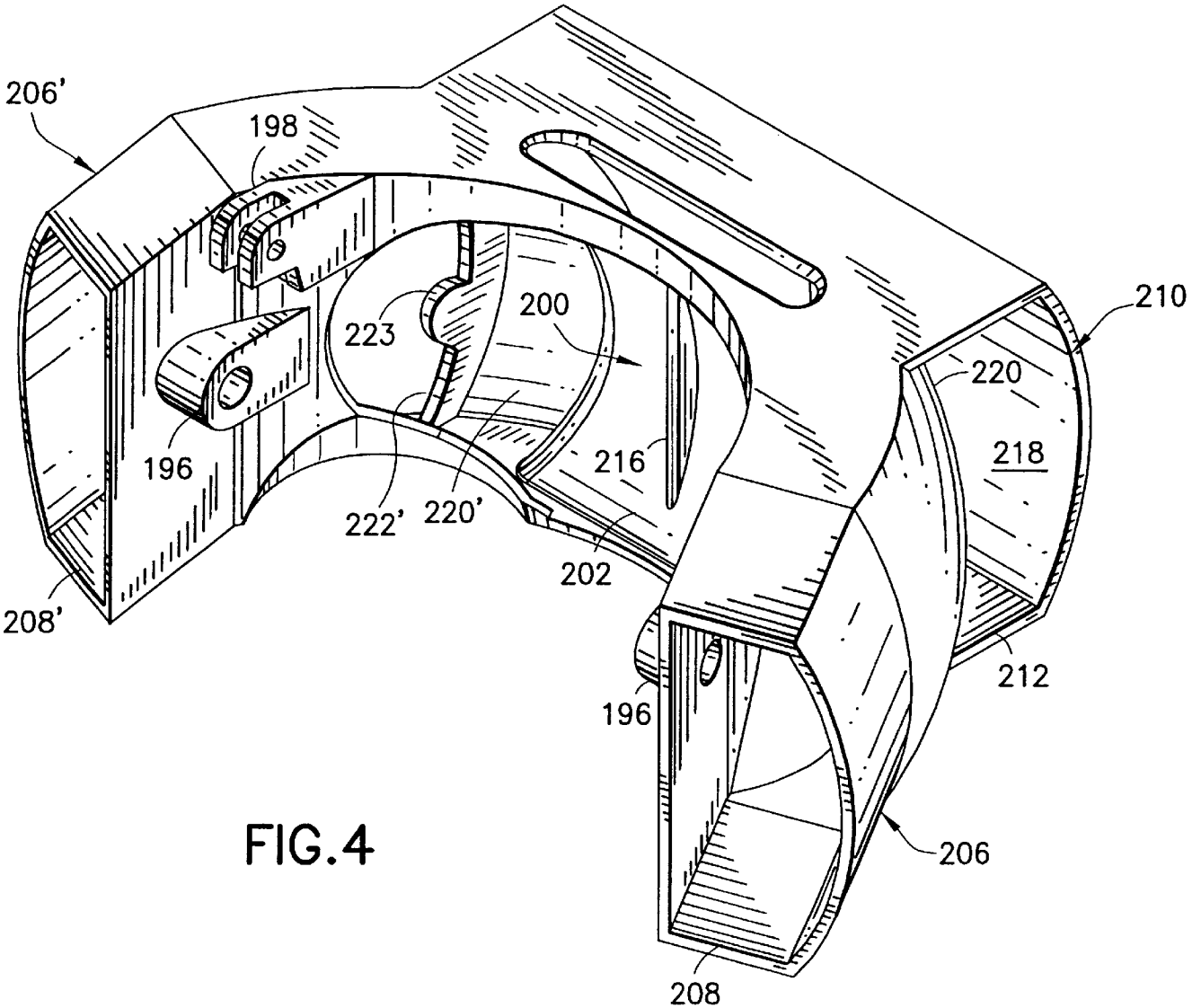
FIG. 4 is a schematic showing an isometric view of the reverse gate in accordance with the preferred embodiments of the invention.

FIGS. 1 and 2 depict a known water jet propulsion system which incorporates a steering nozzle and a reverse gate. These drawings show a basic structure for such a system, as well as one possible means for controlling the rotational positions of the steering nozzle and the reverse gate. The reverse gate shown in FIGS. 1B and 2B is not part of the present invention. The reverse gate in accordance with the preferred embodiments of the invention will be described in detail later with reference to FIGS. 4–7. FIGS. 1–3 are presented for the purpose of disclosing exemplary mechanisms for enabling a boat operator to remotely control the positions of a steering nozzle and reverse gate. However, it should be appreciated that the reverse gate of the invention can be utilized in water jet propulsion apparatus different in structure than that shown in FIGS. 1 and 2.

The water jet propulsion apparatus shown in FIG. 1 is designed to be installed in a cavity under a section of the hull and in flow communication with the outlet of an inlet ramp built into the hull. As seen in FIG. 1, the boat hull 2 has a inlet ramp 6 formed by a pair of opposing sidewalls 8 (only one of which is visible in FIG. 1) and a guide surface or ceiling 10 which curves gently upward in the aft direction. The end of the inlet ramp 6 communicates with a cavity in which the water jet propulsion apparatus is installed. This cavity is defined by a horizontal hull section 12, a vertical hull section 14 and a pair of opposing sidewalls 16 (only one of which is visible in FIG. 1), the cavity being open at the bottom and rear to allow insertion of the water jet propulsion apparatus.

The apparatus depicted in FIG. 1 comprises an inlet housing 18, which is slid into the aforementioned cavity and bolted to the hull by means of a top mounting plate 20 and a front plate 22. At the time of inlet housing installation, the drive shaft 26 is already rotatably mounted in the inlet housing. In particular, the inlet housing 18 comprises a vertical strut 85 having an axial bore which houses a portion of the drive shaft.

During inlet housing installation, the front plate 22 is placed on the inside of the vertical hull section 14 and the inlet housing 18 is placed on the outside of vertical hull section 14. Screws 24 (only one of which is visible in FIG. 1) hold the front plate, vertical hull section and inlet housing together. The front plate 22 has an opening 34 (best seen in FIG. 2) which, in the assembled state, is aligned with an opening 36 in the vertical hull section 14 to allow the output shaft (not shown) from the inboard motor to be coupled to the front end of the drive shaft 26. The studs 28 are affixed to the inlet housing 18. The inlet housing 18 is inserted into the hull cavity and the studs 28 are inserted into through-holes in the hull. The front plate 22 is then positioned and screws 24 are screwed into the inlet housing 18. The top mounting plate 20 is then placed over the studs 28 and secured to the hull. The top mounting plate 20 has an opening 38 which, in the assembled state, is aligned with an opening 40 in the horizontal hull section 12 to allow a shift and steering control housing 42 to be placed in a corresponding opening in the top wall of the inlet housing 18.

The inlet housing 18 has a water tunnel 44 with an inlet 46. The water tunnel 44 comprises a pair of sidewalls 48 (only one of which is shown in FIG. 1) which are generally coplanar with the sidewalls 8 of the hull inlet ramp 6. In addition, water tunnel 44 comprises a guide surface 50 which starts at a point near where the guide surface 10 of the hull inlet ramp 6 ends and then curves gradually upward in the aft direction. The hull 2 and the inlet housing 18 combine to form a single inlet for guiding water toward the inlet of a stator housing 52 located downstream of the inlet housing. An inlet grate 54, comprising a multiplicity of generally parallel tines 56, extends across the inlet 46 to prevent debris from entering. In addition, a ride plate 58 is attached to the bottom of the inlet housing 18.

As shown in FIG. 1, the drive shaft projects in the aft direction out of the inlet housing 18. The impeller is pre-assembled in the unit prior to mounting in the hull. The hub and blades of impeller 60 are preferably integrally formed as one cast piece. The hub of impeller 60 has a splined bore which meshes with splines formed on the external surface of the drive shaft 26, so that the impeller 60 will rotate in unison with the drive shaft. The impeller 60 is held on a threaded end of the drive shaft 26 by a threaded nut 64.

The stator housing 52 comprises inner and outer shells connected by a plurality of stator vanes, all integrally formed as a single cast piece. The stator vanes are designed to redirect the swirling flow out of the impeller 60 into non-swirling flow. A tail cone cover 66 is attached to the radial end face of the stator housing hub. The front of the stator housing 52 is then attached to the rear of the inlet housing 18. A circumferential recess in the stator housing 52 at a position opposing the impeller blade tips has a circular cylindrical wear ring 65 seated therein.

An exit nozzle 70 is attached to and in flow communication with the stator housing 52. Water from the stator housing 52 flows through the space between the tail cone cover 66 and the exit nozzle 70. A steering nozzle 72 is pivotably mounted to the exit nozzle 70 by a pair of pivot assemblies 74 and 76 having collinear axes. The steering nozzle 72 can be turned to change the direction of the water being discharged from the exit nozzle 70.

As best seen in FIG. 2B, the steering nozzle 72 has an arm 68 which is pivotably coupled to a flattened end of a steering rod 114. Displacement of the steering rod 114 in response to operation of a steering cable assembly 78 (see FIG. 2A) causes the steering nozzle 72 to swing in a desired direction about its vertical pivot axis.

In accordance with the preferred embodiments of the invention, the water jet apparatus is provided with a non-steerable reverse gate 80, seen in FIG. 2B. In the forward position, the reverse gate 80 is raised, thereby allowing water to exit the steering nozzle 72 freely. In the reverse position, the reverse gate 80 is lowered to a position directly opposite to the outlet of the steering nozzle 72. The reverse gate is designed to partially reverse the flow of water exiting the steering nozzle 72 when the reverse gate is in the reverse position. To accomplish the foregoing, the arms 98 and 100 of the reverse gate 80 are pivotably mounted to a pair of pivot assemblies 94 and 96 located on opposite sides of the exit nozzle 70 (see FIG. 2B). The support arms 98 and 100 are rigid members which connect to the exit nozzle 70. The reverse gate 80 is pivoted by a shift rod 92, the end of which is coupled to arm 98 of the reverse gate 80 by means of a rod end assembly 102 which comprises a ball socket for allowing horizontal radial motion at the shift lever and vertical radial motion at the reverse gate. The rod end assembly is attached to arm 98 by means of a screw 104 and a lock nut 106. Displacement of the shift rod 92 in response to operation of a shift cable assembly 82 (see FIG. 2A) causes the reverse gate to swing in a desired direction, namely, into forward position or reverse position, with a "neutral" position therebetween.

In the apparatus depicted in FIGS. 1 and 2, the shift and steering cable assemblies (located inside the hull) are respectively coupled to shift and steering rods (located outside the hull) by means of respective lever and shaft assemblies rotatably supported in a shift and steering control housing 42 which penetrates the hull. The shift and steering control housing 42 is installed in a corresponding opening in the top of the inlet housing 18. As seen in FIG. 2A, the housing 42 preferably comprises a base plate 116; as best seen in FIG. 3, the housing 42 further comprises an upper vertical tubular structures 118 and 120 extending above the base plate to different heights. The tubular structures 118 and 120 are reinforced by a rib 122. Additional reinforcement is provided by respective pairs of ribs visible in FIG. 2A. Referring again to FIG. 3, below the base plate 116, the housing has a circular cylindrical lower wall 128 integrally formed with lower vertical tubular structures 130 and 132. The lower wall 128 slides into a circular opening formed in the top wall of the inlet housing 18. The opening in the inlet housing communicates with the exterior of the water jet apparatus via a pair of opposing side channels through which the lower shift and steering levers (described below) respectively pass. Preferably the opening 40 (see FIG. 1A) in the horizontal hull section 12 closely matches the opening in mounting plate. As seen in FIG. 2A, the housing 42 is bolted to the inlet housing 18.

As seen in FIG. 3, the shift and steering control housing 42 has one bore 146 for receiving the shift shaft 88 and another bore 148 for receiving the steering shaft 110. The bore 146 has upper and lower annular recesses in which upper and lower bushings 150 and 152 are respectively inserted; the bore 148 has upper and lower annular recesses in which upper and lower bushings 154 and 156 are respectively inserted. The shift shaft 88 is rotatably supported in bushings 150 and 152, while steering shaft 110 is rotatably supported in bushings 154 and 156. One end of the upper shift lever 86 is secured to the top of the shift shaft 88 by means of a lock nut 158 which screws onto a threaded end of the shift shaft; one end of the upper steering lever 108 is secured to the top of the steering shaft 110 by means of a lock nut 160 which screws onto a threaded end of the steering shaft. (Only a portion of each of the upper levers is shown in FIG. 3.) The upper levers bear on the flanges of the upper bushings during rotation of the lever and shaft assemblies.

Still referring to FIG. 3, a lower shift lever 90 is welded to the bottom of the shift shaft 88, while a lower steering lever 112 is welded to the bottom of the steering shaft 110. A lower washer 178 is installed between the lower shift lever 90 and the lower vertical tubular structure 130 of the shift and steering control housing 42, while a lower washer 180 is installed between the lower steering lever 112 and the lower vertical tubular structure 132 of housing 42. The washers 178 and 180 provide a bearing surface. During assembly, the bottoms of the shafts are supported by a boss 138. The full length of the lower steering lever 112 is shown in FIG. 3, while only a portion of the lower shift lever 90 is depicted. FIG. 3 shows a clevis 182 and a shoulder screw 184 for attaching the distal end of the lower steering lever 112 to the forward end of the steering rod (not shown in FIG. 3). Similarly, the distal end of the lower shift lever is attached to the forward end of the shift rod by means of a clevis and shoulder screw coupling (not shown in FIG. 3).

Referring to FIG. 2A, the distal end of the upper shift lever 86 is attached to the shift cable assembly 82 by means of a clevis 186 and a clevis pin 188. These components are located inside the hull of the boat (see FIG. 1A). Displacement of the end of the shift cable assembly causes the shift lever and shaft assembly to rotate. Likewise the distal end of the upper steering lever 108 is attached to the steering cable assembly 78 by means of a clevis 190 and a clevis pin 192, and displacement of the end of the steering cable assembly causes the steering lever and shaft assembly to rotate. As best seen in FIG. 1A, the shift cable assembly 82 is supported by a bracket 194 and the steering cable assembly 78 is supported by a bracket 196, both brackets being integrally connected to and extending vertically upward from the top mounting plate 20. In response to operation of the steering cable assembly 78, the steering nozzle can be selectively turned left or right to steer the boat as desired during water jet operation. In response to operation of the shift cable assembly 82, the reverse gate can be selectively raised or lowered.

In accordance with the preferred embodiments of the invention, the reverse gate is pivotably mounted to the exit nozzle, and is pivotable between first and second shift positions. The reverse gate in the first shift position is removed from the path of water exiting the exit nozzle and in the second shift position is disposed in the path of water exiting the exit nozzle. The basic principle of reverse gate design is that if a planar surface (flat or contoured) is positioned aft of the pump discharge, the resulting diffusion is a 360-degree fan-out pattern. Contouring the planar surface will (to varying degrees) alter the fan-out pattern, but in general the more the discharge is managed, the more it is restricted. Greater restriction will cause the impeller to stall at lower rpm. Also, as greater amounts of reverse discharge are drawn into the pump inlet, the impeller is more likely to stall at lower rpm due to entrained air. In addition, the deflector surfaces must be defined by a radius or radii that originate at the pivot pin centerline. That pivot centerline must be positioned on the vertical centerline of the exit nozzle. Using these geometric characteristics will balance opening and closing loads. The force required to open or close the gate can be supplemented by addition of features applied to the deflector surface.

Figure 5:
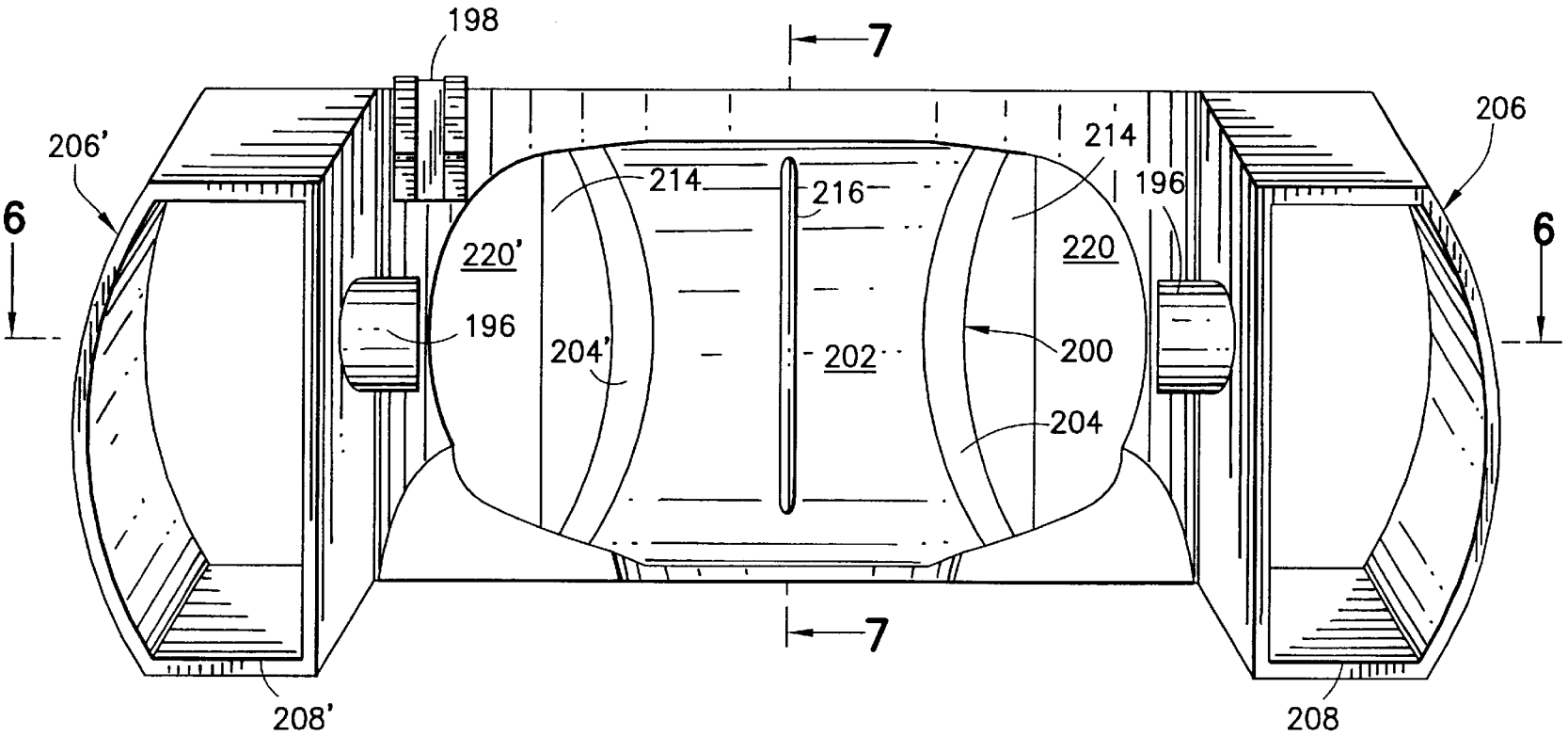
FIG. 5 is a schematic showing a front elevational view of the reverse gate depicted in FIG. 4.
Figure 6:
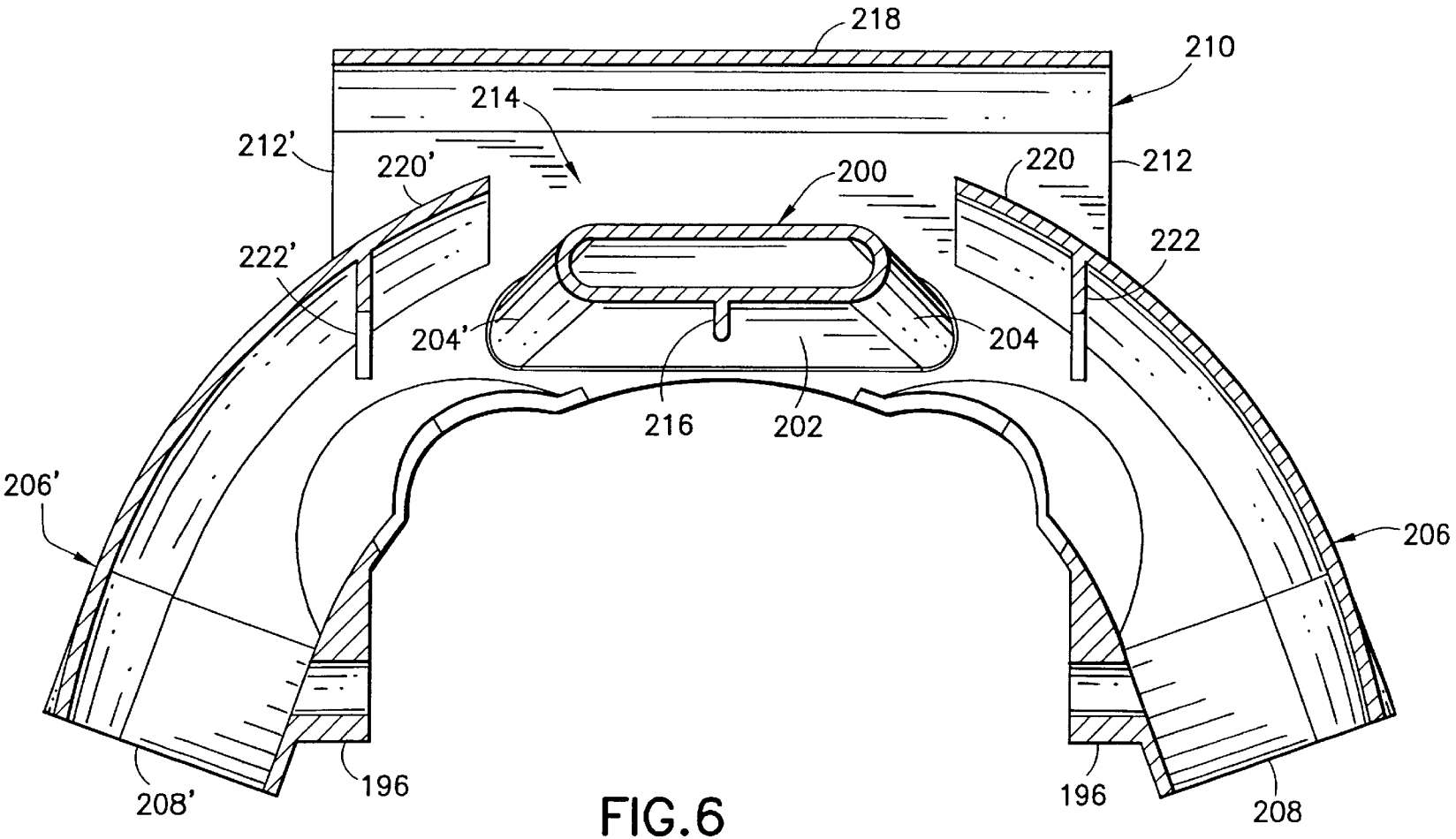
FIGS. 6 and 7 are schematics showing sectional views of the reverse gate depicted in FIGS. 4 and 5, the sections being respectively taken along the dashed lines designated 6—6 and 7—7 in FIG. 5.
Figure 7:
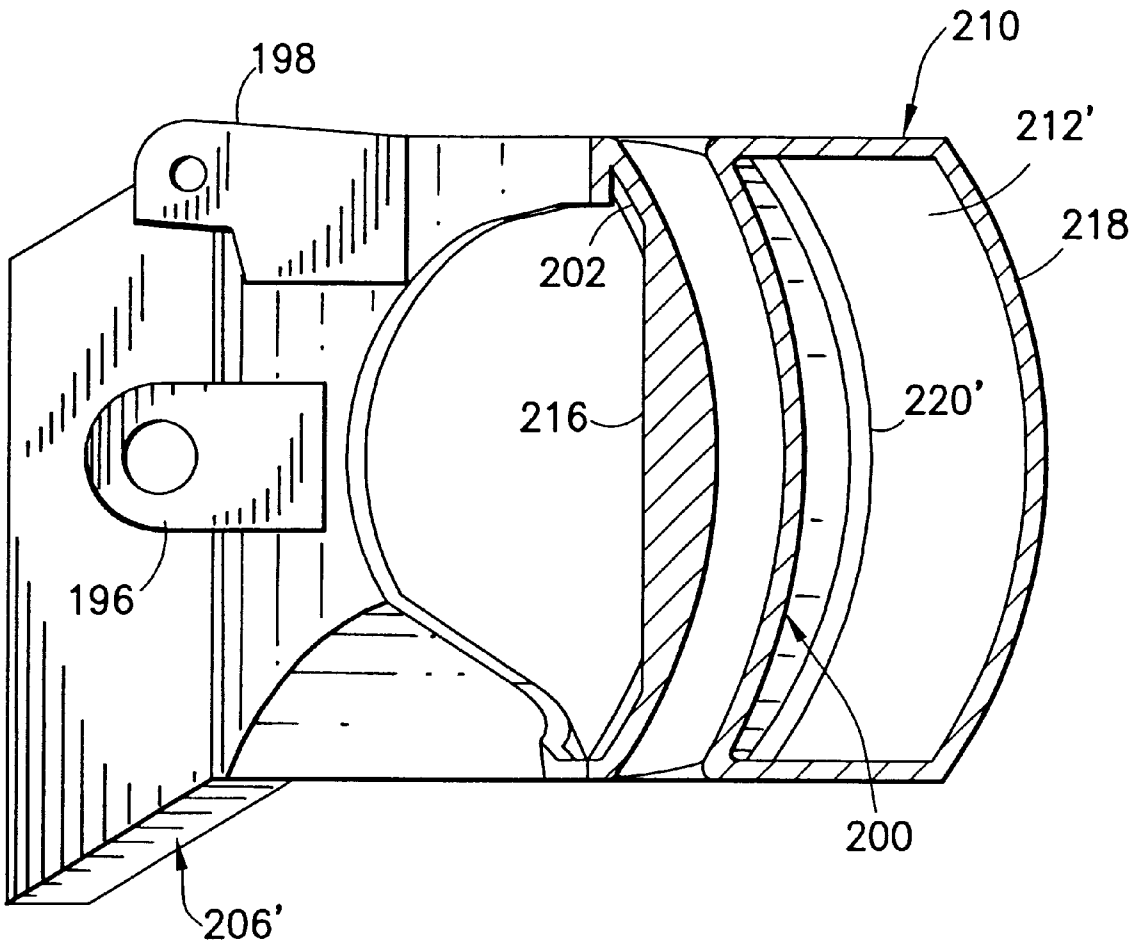

The reverse gate in accordance with one preferred embodiment of the invention is shown in FIGS. 4–7, with the pivot pin assemblies and the shift rod not shown. The pivot pin would be received in coaxial pivot bores 196 and 196'. These bores are formed in bosses which are integrally formed with the inner side wall of the corresponding flow-reversing passage 206 and 206'. The bore centerlines define the pivot axis A. As seen in FIG. 6, the bores 196 and 196' respectively communicate with the flow channels formed by passages 206 and 206'. The pivot pins (not shown) would be inserted in pivot bores 196 and 196', and the reverse gate would pivot on those pins.

The reverse gate in accordance with the preferred embodiments utilizes a hollow deflector body 200 comprising a deflecting surface 202 which is either flat or which is curved vertically and straight laterally, and having rounded port and starboard side edges 204 and 204'. Preferably, the deflector body 200 has an oval cross section and an hourglass shape when viewed from front or rear. In the fully down reverse gate position, the front face 202 of the deflector is disposed directly in front of the discharge aperture of the steering nozzle. The deflector body 200 is hollow to reduce weight, thereby reducing the required operating loads.

Referring to FIG. 6, the reverse gate further comprises port and starboard flow-reversing passages 206 and 206' having respective discharge openings 208 and 208'. The port reversing passage 206 begins near the rounded side edge 204 on the port side of the deflector 200 and curves forward, preferably to a discharge "splay" angle of about +10 degrees. Similarly, the starboard reversing passage 206' begins near the rounded side edge 204' on the starboard side of the deflector 200 and curves forward, preferably to a discharge "splay" angle of about +10 degrees. To minimize the distance separating the center of gravity of the reverse gate and the pivot axis A, preferably the discharge openings 208 and 208' of the flow-reversing passages are disposed forward of the pivot axis A. Each of the flow-reversing passages 206 and 206', at its discharge opening, comprises a generally planar side wall and an opposing vertically curved sidewall.

In accordance with the preferred embodiment, the concave deflecting surface 202 is substantially centered at the pivot axis. For example, the deflecting surface 202 may be circular cylindrical, with the radius being centered along the pivot axis. Preferably, a vertical rib 216 runs along a centerline of the deflecting surface 202. As seen in FIGS. 5 and, the respective side surfaces 204 and 204', on opposing sides of the deflecting surface, have a toroidal curvature. As seen in FIG. 5, the side surfaces are curved vertically to form an hourglass shape, with the deflector 200 being most narrow along a horizontal midplane. As shown in FIG. 6, each side surface 204 and 204' may have a semicircular cross-sectional shape.

The flow-reversing passages 206 and 206' are separated by an aperture 214 located behind the deflector body 200. A lateral steering passage 210 is located behind the aperture 214 and forms a channel which communicates with that aperture. The lateral steering passage 210 has respective port and starboard discharge openings 212 and 212'. The lateral steering passage comprises an aft wall 218, which is vertically curved and laterally straight, and respective portions of the common walls 220 and 220', which are common to the steering passage and to the flow-reversing passages.

When the steering nozzle is centered, the primary water exit path is spray which bounces off of the deflector body 200 and flows forward through the reversing passages 206 and 206'. Steering, i.e., turning the steering nozzle about its pivot axis, allows some of the nozzle discharge to miss the deflector body 200 and escape around the backside, through the aperture 214 behind the deflector body and into the lateral steering passage 210. The flow around the deflector body 200 is facilitated by the Coanda effect, i.e., the tendency of a liquid coming out of a jet to travel close to the wall contour even if the wall's direction of curvature is away from the jet's axis. For example, when the steering nozzle is turned to port, some of the discharged water will flow around the deflector body 200 and out the starboard discharge port 212' of the steering passage 210; less discharged water will flow out the port discharge port 212 of steering passage 210. Conversely, when the steering nozzle is turned to starboard, some of the discharged water will flow around the deflector body 200 and out the port discharge port 212 of the steering passage 210; less discharged water will flow out the starboard discharge port 212'.

In accordance with the preferred embodiment shown in FIGS. 4–7, the common walls 220 and 220' are vertically and laterally curved. The ends of these common walls change from a compound curve to a simple curve (curved vertically, straight laterally). This straightens the flow and keeps the steering thrust from bending around the edge and going the wrong way through the steering passage.

The reverse gates in accordance with the preferred embodiments further comprise a pair of baffles 222 and 222' respectively arranged inside the flow-reversing passages 206 and 206' and extending forward from the curved walls 220 and 220' respectively. As best seen in FIG. 6, the baffles 222 and 222' are disposed on opposing sides of the deflector body 200. These baffles enhance steering thrust by directing more water around the deflector body when the steering nozzle is turned.

In accordance with one preferred embodiment, each baffle 222 and 222' has a paddle shape 223 (shown in FIG. 4) extending forward from the curved walls 220 and 220' respectively. The paddle-shaped baffles are respectively situated on opposing sides of the deflector body and disposed to deflect water into the steering passage. These paddles 223 provide the opportunity to tune the port/starboard steering characteristics independently. In all reverse configurations, the steering response is unequal. This may be the result of a swirl component in the nozzles. In one exemplary embodiment, the starboard paddle was made 40% larger than the port paddle to increase steering thrust to starboard.

Optionally, lateral bars can be added to the top, middle, and/or bottom of the deflecting surface.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "longitudinal" refers to a direction generally parallel to the centerline axis of a water jet propulsion system; the term "lateral" refers to a direction generally perpendicular to the longitudinal direction and generally parallel to a reverse gate pivot axis; and the term "vertical" refers to a direction generally perpendicular to the plane defined by the longitudinal and lateral axes. Also, as used in the claims, the term "duct" may comprise a single part or a plurality of assembled parts. For example, in the disclosed preferred embodiment, the inlet housing, stator housing and exit nozzle form a "duct". However, the present invention encompasses forming the inlet housing and stator housing as one piece, forming the stator housing and the exit nozzle as one piece, forming the inlet housing as two pieces, forming the stator housing as two pieces, and so forth. All such variations fall within the meaning of "duct" as that term is used in the claims.

What is claimed is:

1. A reverse gate comprising:

a pair of pivot structures having a common pivot axis;

a deflector body comprising a deflecting surface respective curved side surfaces on opposing sides of said deflecting surface, said deflector body having an hourglass shape when viewed from the front;

first and second flow-reversing passages which respectively begin near said opposing sides of said deflector body, curve away from and forward of said deflector body, and end with a respective discharge opening, said first and second flow-reversing passages being separated by an aperture located behind said deflector body; and a lateral steering passage located behind said aperture and forming a channel which communicates with said aperture, said lateral steering passage having discharge openings at opposite ends thereof.

2. The reverse gate as recited in claim 1, wherein said deflecting surface is straight laterally and straight vertically.

3. The reverse gate as recited in claim 1, wherein said deflecting surface is straight laterally and curved vertically with a curvature that is substantially centered at said pivot axis.

4. The reverse gate as recited in claim 1, further comprising a vertical rib running along a centerline of said deflecting surface of said deflector body.

5. The reverse gate as recited in claim 1, wherein a discharge splay angle at said discharge opening of each of said flow-reversing passages is approximately 10 degrees.

6. The reverse gate as recited in claim 1, wherein said discharge openings of said flow-reversing passages are forward of said pivot axis.

7. The reverse gate as recited in claim 1, wherein each of said pivot structures comprises a respective circular cylindrical bore which communicates with a respective flow-reversing passage.

8. The reverse gate as recited in claim 1, further comprising a pair of baffles respectively arranged inside said flow-reversing passages on opposing sides of said deflector body.

9. The reverse gate as recited in claim 8, wherein said baffles are dimensioned differently.

10. The reverse gate as recited in claim 1, wherein each of said first and second flow-reversing passages, at its discharge opening, comprise a generally planar side wall and an opposing vertically curved sidewall.

11. The reverse gate as recited in claim 1, wherein said lateral steering passage, at each of its discharge openings, comprises a vertically and laterally curved side wall and an opposing vertically curved and laterally straight sidewall.

12. The reverse gate as recited in claim 1, wherein said deflector body is hollow and has an oval cross section.

13. The reverse gate as recited in claim 1, wherein said lateral steering passage comprises an aft wall which is vertically curved and laterally straight.

14. A reverse gate comprising:

a pair of pivot structures having a common pivot axis;

a deflector body comprising a deflecting surface which is straight laterally, and opposing sides which are vertically concavely curved and longitudinally convexly curved;

first and second flow-reversing passages which respectively begin near said opposing sides of said deflector body, curve away from and forward of said deflector body, and end with a respective discharge opening, said first and second reversing passages being separated by an aperture located behind said deflector body; and a lateral steering passage located behind said aperture and forming a channel which communicates with said aperture, said lateral steering passage having discharge openings at opposite ends thereof.

15. The reverse gate as recited in claim 14, wherein said aperture extends laterally beyond the limits of said deflector body.

16. The reverse gate as recited in claim 14, wherein said deflecting surface is curved vertically with a curvature that is substantially centered at said pivot axis.

17. The reverse gate as recited in claim 14, further comprising a vertical rib running along a centerline of said deflecting surface of said deflector body.

18. The reverse gate as recited in claim 14, further comprising a pair of baffles respectively arranged inside said flow-reversing passages on opposing sides of said deflector body.

19. The reverse gate as recited in claim 14, wherein each of said first and second flow-reversing passages, at its discharge opening, comprise a generally planar side wall and an opposing vertically curved sidewall.

20. The reverse gate as recited in claim 14, wherein said lateral steering passage, at each of its discharge openings, comprises a vertically and laterally curved side wall and an opposing vertically curved and laterally straight sidewall.

21. The reverse gate as recited in claim 14, wherein said deflector body is hollow and has a generally oval cross section, and said side surfaces are generally toroidal in shape.

22. A water jet propulsion system comprising:

a duct having an inlet and an outlet;

an impeller which is rotatable within said duct;

a steering nozzle pivotably mounted to an outlet end of said duct and having an inlet and an outlet, said steering nozzle being pivotable between first and second steering positions, and said steering nozzle inlet being in flow communication with said duct outlet; and a reverse gate pivotably mounted to said duct, said reverse gate being pivotable about a pivot axis between first and second shift positions, said reverse gate in said first shift position being removed from the path of water exiting said steering nozzle outlet and in said second shift position being in the path of water exiting said steering nozzle outlet, wherein said reverse gate comprises:

a deflector body comprising a deflecting surface which is straight laterally, and opposing sides which are vertically concavely curved and longitudinally convexly curved;

first and second flow-reversing passages which respectively begin near said opposing sides of said deflector body, curve away from and forward of said deflector body, and end with a respective discharge opening, said first and second flow-reversing passages being separated by an aperture located behind said deflector body.

23. The water jet propulsion system as recited in claim 22, wherein said deflecting surface is curved vertically with a curvature that is substantially centered at said pivot axis.

24. The water jet propulsion system as recited in claim 22, wherein said reverse gate further comprises a lateral steering passage located behind said aperture and forming a channel which communicates with said aperture, said lateral steering passage having discharge openings at opposite ends thereof.

25. The water jet propulsion system as recited in claim 22, wherein said deflector body has an oval cross section and an hourglass shape when viewed from the front.

26. The water jet propulsion system as recited in claim 22, further comprising a vertical rib running along a centerline of said deflecting surface of said deflector body.

27. The water jet propulsion system as recited in claim 22, wherein a discharge splay angle at said discharge opening of each of said flow-reversing passages is approximately 10 degrees.

28. The water jet propulsion system as recited in claim 22, wherein said discharge openings of said flow-reversing passages are forward of said pivot axis.

29. The water jet propulsion system as recited in claim 22, further comprising a pair of baffles respectively arranged inside said flow-reversing passages on opposing sides of said deflector body.

30. The water jet propulsion system as recited in claim 29, wherein said baffles are dimensioned differently.

31. The water jet propulsion system as recited in claim 22, wherein each of said first and second flow-reversing passages, at its discharge opening, comprise a generally planar side wall and an opposing vertically curved sidewall.

32. The water jet propulsion system as recited in claim 23, wherein said lateral steering passage, at each of its discharge openings, comprises a vertically and laterally curved side wall and an opposing vertically curved and laterally straight sidewall.

* * * * *